US005154196A

United States Patent [19]

Moffat

[11] Patent Number: 5,154,196

[45] Date of Patent: Oct. 13, 1992

[54] HAIR ACCESSORY

[76] Inventor: Patty Moffat, 830 N. Fountain, Cape Girardeau, Mo. 63701

[21] Appl. No.: 675,646

[22] Filed: Mar. 27, 1991

[51] Int. Cl.[5] ..... A45D 8/28

[52] U.S. Cl. ..... 132/278; 132/275

[58] Field of Search ..... 132/275, 277, 278, 279; 63/1.1, 2, 21, 23

[56] References Cited

U.S. PATENT DOCUMENTS

| | | | |
|---|---|---|---|
| 2,495,504 | 1/1950 | Behr | 132/279 |
| 3,225,565 | 12/1965 | Bohlinger et al. | 63/2 |
| 3,271,977 | 9/1966 | Bohlinger et al. | 63/1.1 |
| 3,678,946 | 7/1972 | Katz | 132/278 |
| 4,406,296 | 9/1983 | Wexler et al. | 132/275 |

FOREIGN PATENT DOCUMENTS

| | | | |
|---|---|---|---|
| 649696 | 9/1928 | France | 132/278 |
| 2174001 | 10/1986 | United Kingdom | 132/275 |

*Primary Examiner*—John J. Wilson
*Assistant Examiner*—Frank A. LaViola
*Attorney, Agent, or Firm*—Polster, Lieder Woodruff & Lucchesi

[57] ABSTRACT

A hair accessory having at least two barrettes each of which being separately clippable onto the hair of the user and the barrettes being joined together to form an ornamental assembly. Lacing joins the barrettes together and a plurality of decorative beads which are stringable onto the lacing provide a decorative appearance.

9 Claims, 4 Drawing Sheets

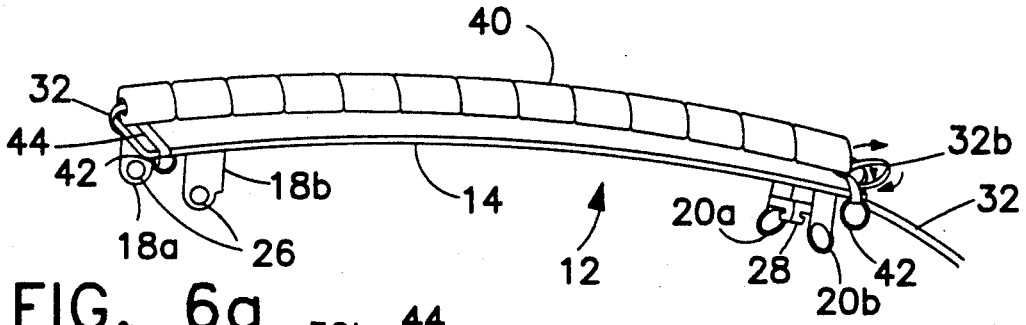
FIG. 6a
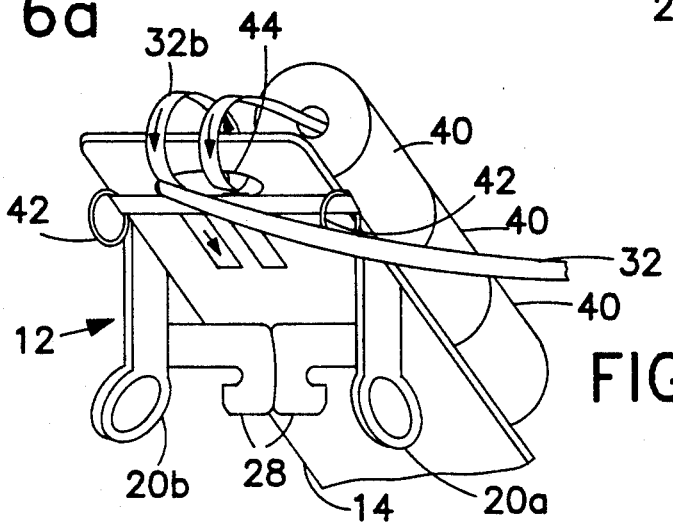
FIG. 6b
FIG. 7
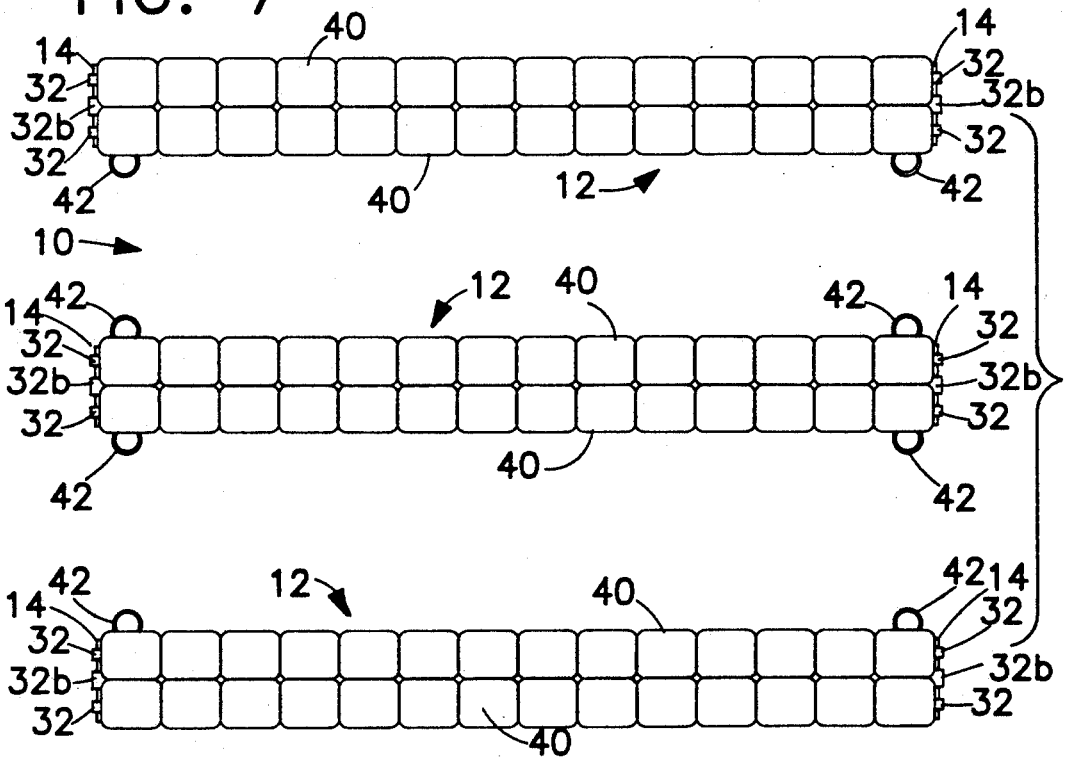

HAIR ACCESSORY

BACKGROUND OF THE INVENTION

This invention relates to hair accessories and, more particularly, to a multi-tiered barrette which can be worn by a person in their hair, and a method for making the barrette.

Many people, especially women, enjoy wearing their hair long. In addition, many of these people like to gather their hair in various ways, and for this purpose use an accessory called a barrette. While barrettes come in various sizes, so a person is able to work their hair into different styles, people have, until now, been limited in the types of arrangements they can make. For more elaborate arrangements, the person has had to employ a number of barrettes. Working these into the hair is time consuming and sometimes cumbersome, particularly if the individual has no assistance. Also, barrettes sometimes work themselves loose, and fall out of the hair. While a barrette is an inexpensive item, its loss nevertheless can be irritating. This is especially true if a lot of work has gone into creating a hairstyle. The person may think the effect they have tried to achieve is ruined and that a lot of effort has been wasted. The use of a multiple barrette arrangement, in accordance with the present invention, allows people an opportunity to achieve new and dramatic styling arrangements.

SUMMARY OF THE INVENTION

Among the several objects of the present invention may be noted the provision of a hair accessory; the provision of such an accessory which is a decorative accessory; the provision of such an accessory to involve a plurality of barrettes joined together in a tiered arrangement; the provision of such an accessory utilizing a wide variety of decorative bead arrangements with the barrettes; and, the provision of such a hair accessory which is readily constructed and is attractive when worn in the hair.

Briefly, an ornamental accessory of the present invention is wearable in a person's hair. The accessory includes a plurality of barrettes each of which is separately clippable onto the hair. Strands of lacing are used to join the barrettes together into an ornamental assembly so that when worn in the hair, the barrettes are arranged vertically. Beads may be strung on the strands to effect various decorative patterns. Each barrette has strands of lacing extending across the barrette with rings mounted on the respective ends of these strands. The strands of lacing by which the barrettes are joined are attached to the rings to complete the assembly. A method of making the accessory is also disclosed. Other objects and features will be in part apparent and in part pointed out hereinafter.

BRIEF DESCRIPTION OF THE DRAWINGS

In the drawings.

FIGS. 6*a* and 6*b* illustrate a fourth step in making the accessory;

FIG. 7 is an elevational view of a partially completed accessory;

Corresponding reference characters indicate corresponding parts throughout the drawings.

DESCRIPTION OF THE PREFERRED EMBODIMENT

Figure 1:
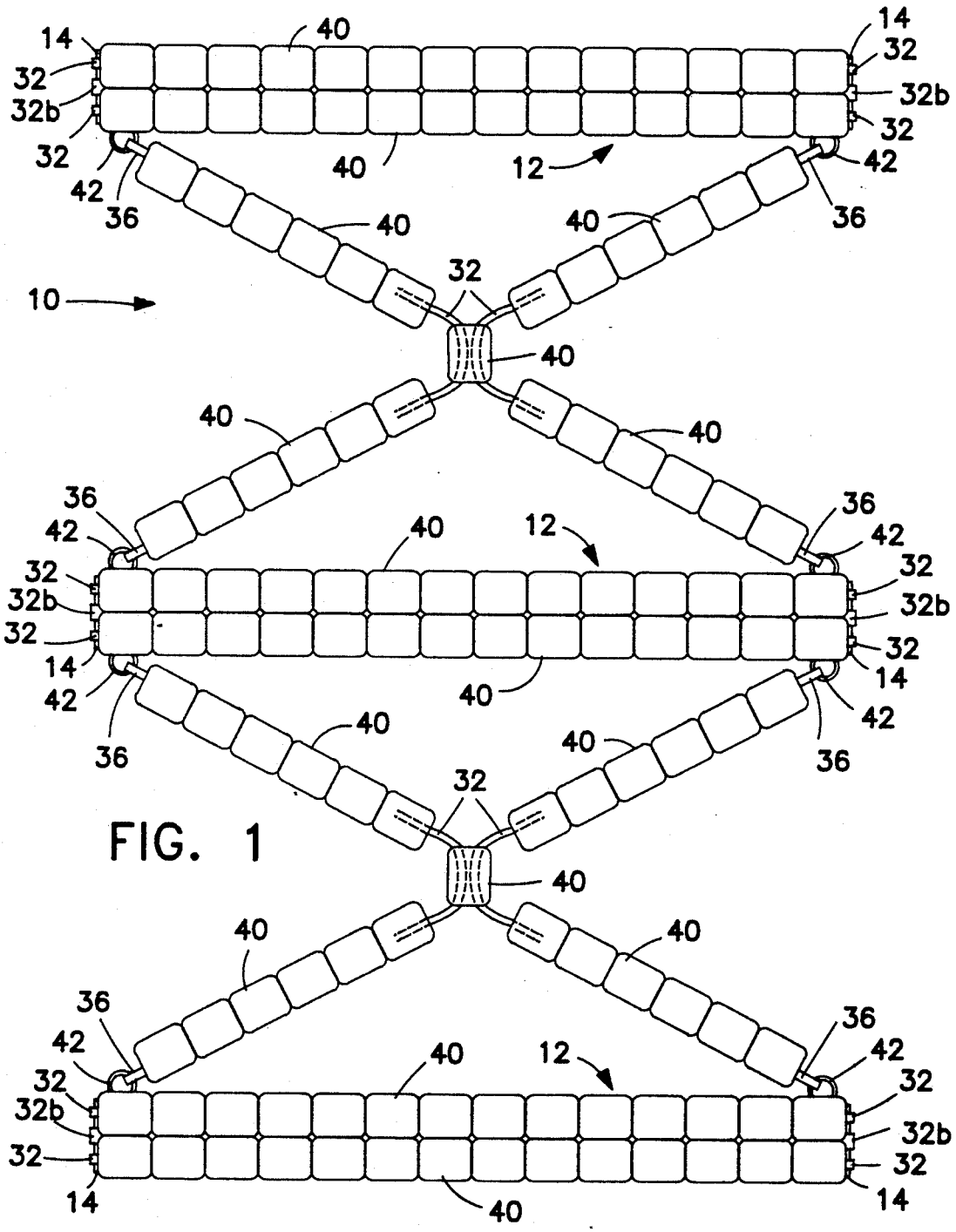
FIG. 1 is an illustration of the accessory of the present invention which is worn in a person's hair.

Referring to the drawings, an ornamental accessory to be worn in a person's hair is indicated generally 10. The accessory comprises a multi-tiered arrangement of barrettes 12 which are joined together in a manner to be described hereinafter. The accessory, as described, comprises three (3) barrettes, but it will be understood that more, or fewer, barrettes can be used. The practical limitation is the desired spacing between tiers, which is variable, or the length of hair in which the accessory will be worn, or both. Further, while the length of the barrettes shown in the drawings are equal, the lengths could be variable so that different ornamental configurations are possible. Thirdly, it is a feature of the invention that beads are used as part of the accessory. The size, color, and arrangement of these beads is variable in accordance with the taste of the maker of the accessory so that a wide variety of combinations are possible.

Figure 2:
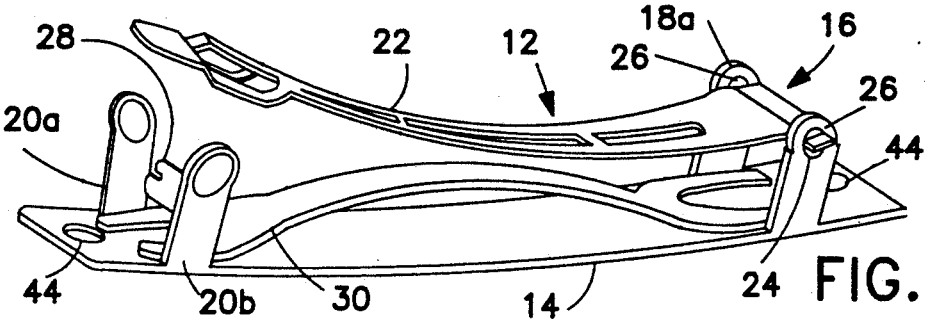
FIG. 2 is a perspective view of a barrette used in making the accessory.

Referring to FIG. 2 a barrette 12 has an elongate, generally rectangular shaped body or bar 14, the corners of which are typically rounded. On the underside of the body is a clip assembly 16. This assembly includes a pair of opposed posts 18*a*, 18*b* positioned on opposite sides of the body, at one end of the body. A second pair of opposed posts 20*a*, 20*b* are positioned at the opposite end of the body. A clip 22 has an elongate, generally rectangular shape when viewed in plan. The width of the clip is less than the distance between the posts for the clip to fit therebetween. The clip, which is concave throughout its length has outwardly extending tabs 24 fitting in openings 26 in the posts 18*a*, 18*b* to form a hinge for opening and closing the clip. A spring bar 28 extends between the posts at the opposite end of the clip and the associated end of the clip is formed to snap fit onto the latch to close the clip. Lastly, a convexedly curving spring tension bar 30 is mounted to the backside of the bar. The clip comprises a spring when it is latched to hold the barrette in place in the hair.

Referring to FIGS. 3–6*b*, the manufacture of a decorative accessory 10 involves, for example, use of the following materials:

Three large spring barrettes 12

75 inches of a vinyl lace 32 of any suitable or desired color 8 5 mm. jump rings 42 (silver or gold)

32 inches of a 34ga beading wire 36 (silver of gold)

128 6×9 mm pony beads 40 of any suitable or desired color.

The following tools are also used:

Hot glue gun (high or low temperature)

ruler scissors tweezers

Figure 3:
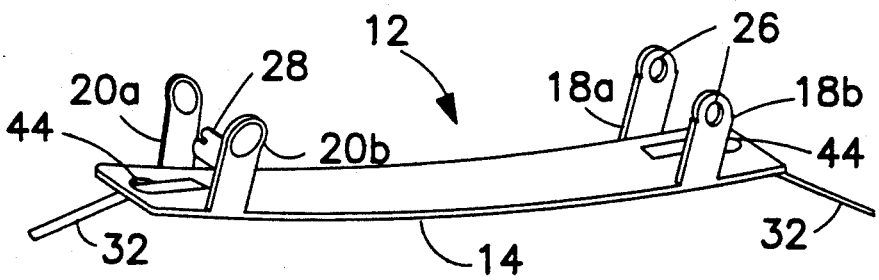
FIG. 3 is a simplified perspective view of the barrette illustrating a first step in making the accessory.

As seen in FIG. 3, the first step is to disassemble swing bar 28 from a barrette. Next, cut 10 pieces of the vinyl lace 32 to 7½ inch lengths. Third, cut 8 pieces of the beading wire 36 to 4 inch lengths.

Referring again to FIG. 3, glue one end of one piece of the 7½ inch lace 32 to the back of bar 14 by inserting the end of the piece through a hole 44 at one end of the bar. The end of the lace is inserted from the front side of the barrette. Do the same at the other end of the barrette with a second piece of lace inserted through a hole 44 at the other end of the barrette.

Figure 4A:
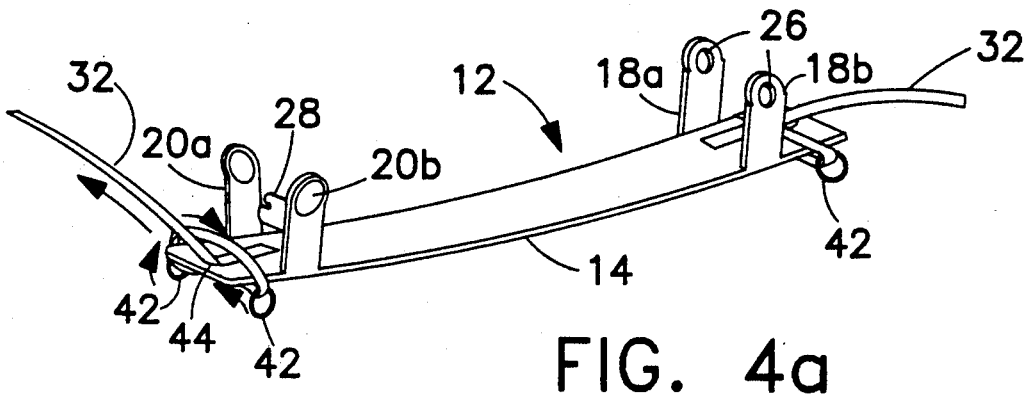
FIGS. 4*a* and 4*b* illustrate a second step in making the accessory.
Figure 4B:
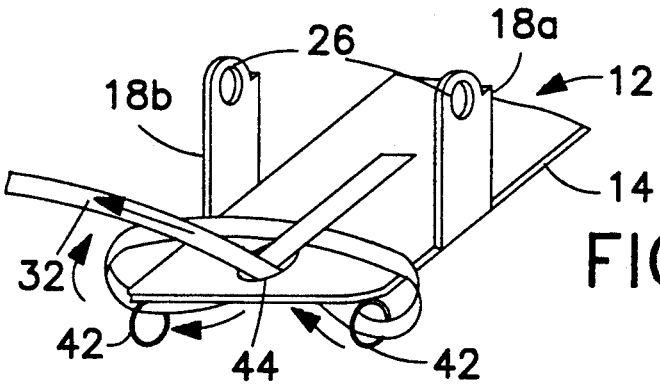

Referring to FIGS. 4*a* and 4*b*, bring each piece of lace around from the front side to the back side of the barrette, from the bottom side of the barrette. Insert two jump rings 42 onto the lace. Next, bring the piece of lace from across the back of the barrette, from over the top thereof, to the front of the barrette. Insert the free end of the piece through the same hole in the barrette the lace was originally inserted through and pull until snug. Make sure the lace does not get twisted in the process.

Repeat the above steps for the other end of the barrette. In each instance, the laces should now hang from the back side of the barrette in opposite directions. See FIG. 4*a*. This barrette will be the center barrette in the accessory.

Figure 5:
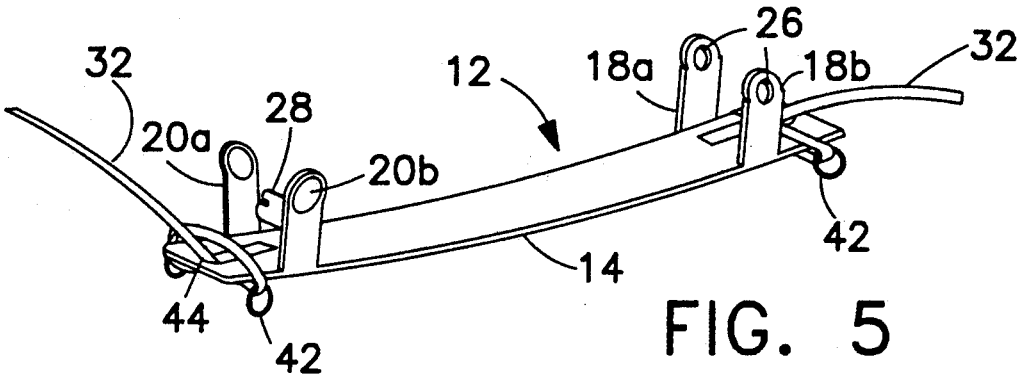
FIG. 5 illustrates a third step in making the accessory.

For the other two barrettes, repeat the above steps except use only one jump ring per end as shown in FIG. 5 and 7. There will now be three completed barrettes. One barrette will have 2 jump rings per end (this will be the center barrette), and the other two barrettes will have 1 jump ring per end (these will be end barrettes).

Next, take one of the free ends of the lace and slide a number, for example, 13 beads onto the lace. Then, glue the beads to the bottom half of the front face of the bar of the barrette, trying not to cover the hole at the end of the barrette with glue. If glue does get in the hole, use the tweezers to clear out the hole. See FIG. 6*b*. After the beads are glued, bring the end of the lace over the end of the barrette and around to the back. Then, insert it through the hole at the end, bring it over the end again, and finally, tuck it under the lace already in place. This will allow the jump ring to slide from side-to-side. Pull the lace snug. Now, glue a small amount of lace down to the back of the barrette. Cut off the excess lace. See FIG. 6*b*. Repeat for the other end of barrette. Repeat the above steps for the other two barrettes. There will now be three complete beaded barrettes.

After completing the above, reassemble the barrettes by putting the tension and swing bar back onto the barrettes. Align all three barrettes so the swing bar opens in the same direction.

Figure 8:
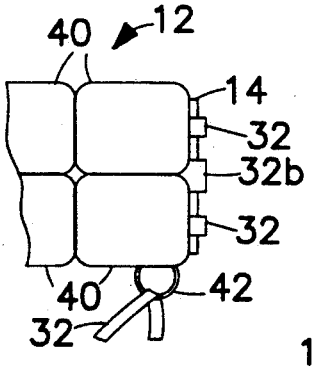
FIG. 8 illustrates a fifth step in making the accessory.
Figure 10:
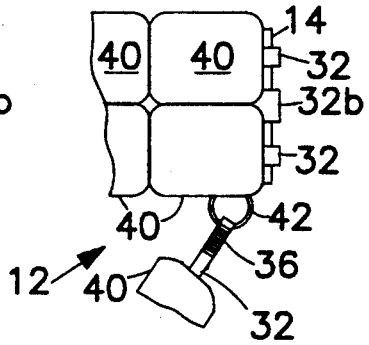
FIG. 10 illustrates a sixth step in making the accessory.
Figure 11:
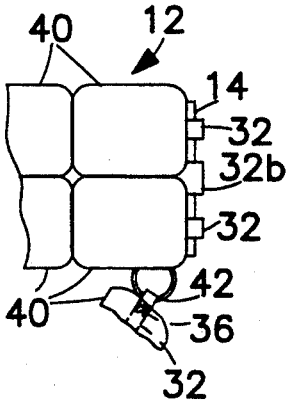
FIG. 11 illustrates a seventh step in making the accessory.

Taking the center barrette first, the barrette 12 with 2 jump rings at each end, thread a 7½ inch piece of lace through one of the jump rings about ¼ inch. Fold the end of the lace back over on itself, letting the lengths of lace set together back-to-back. Take a 4 inch piece of beading wire and wrap it tightly around the lace, the wrapping being approximately ⅛ inch from the jump ring. Trim the short end of the lace as close to the beading wire as possible. See FIGS. 8, 10, and 11. Repeat the above for the other rings making sure in each instance the lace is going the same way.

Figure 9:
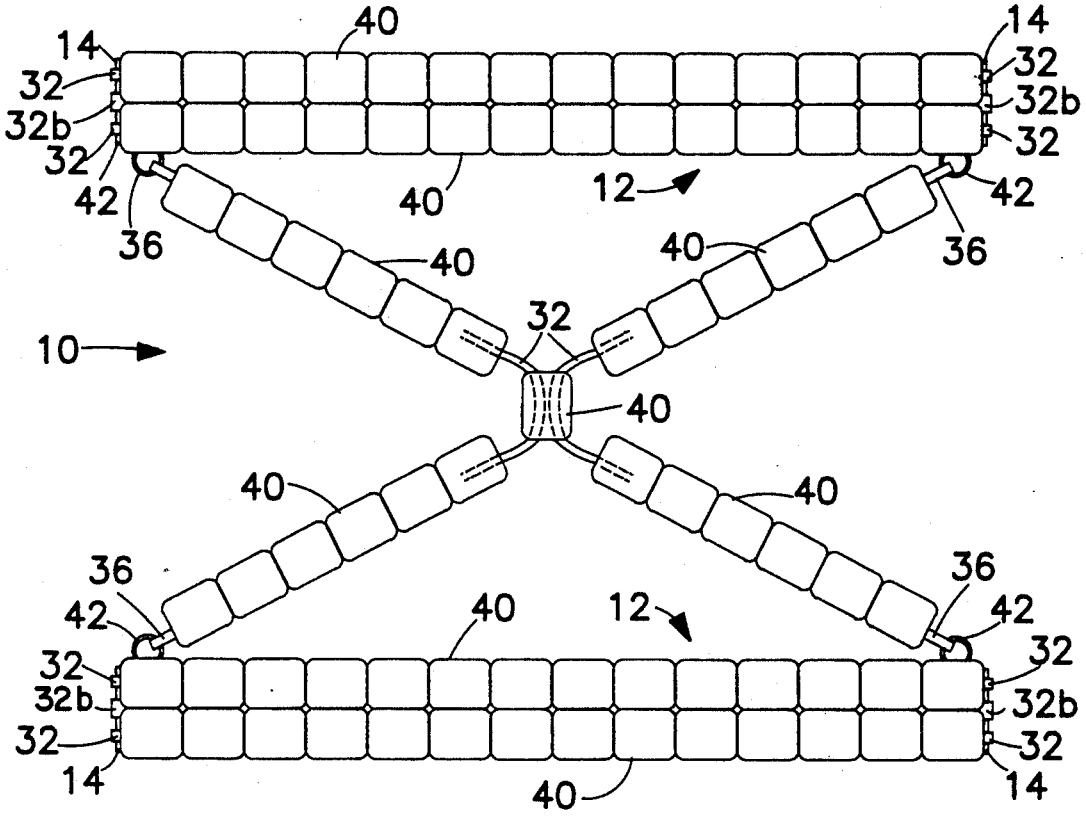
FIG. 9 is an elevational view of a further partially completed accessory.

After completing the above, place 6, for example, beads on each length of lace and slide them up the beading wire until they meet the jump ring. The beads should slide over the beading wire to cover it. Thread both lengths of lace through one bead and slide this bead up to the other beads. Be careful not to twist the lace. Now, place 6 more beads onto the free ends of the other pieces of lace. Then, attach the ends of the lace to the jump rings connecting to one of the end barrettes. Wrap the beading wire around the lace a few times, using the end of the lace. Pull the lace so the beading wire and beads slide up to the jump rings no more than ⅛ inch away from jump ring. Wrap the beading wire tightly around the lace. Repeat these steps for the other side of the barrette. You should now have the center barrette, with two jump rings per end, attached to one of the end barrettes, with one jump ring per end, in a X shape. See FIG. 9. Repeat the above steps until the accessory is complete.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

I claim:

1. An accessory wearable in the hair comprising:

at least two barrettes each of which is separately clippable onto the hair and each of which has a bar with an opening in each end thereof;

means for joining the barrettes together into an ornamental assembly in which the barrettes are joined in a spaced apart relationship, the joining means including a lacing and means for attaching ends of the lacing to the underside of the bars; and, means carried by the joining means for providing a decorative appearance to the ornament and including a plurality of beads stringable onto the lacing.

2. The accessory of claim 1 wherein the barrettes are arranged so they all open and close in the same direction.

3. The accessory of claim 2 wherein the barrettes are each of the same length.

4. The accessory of claim 2 wherein the barrettes are of a different length.

5. The accessory of claim 1 comprising at least two strands of lacing on which beads are stringable, ends of the strands being attachable to the underside of a barrette whereby parallel rows of beads extend across the outer face of the barrette.

6. The accessory of claim 5 wherein the joining means further includes rings stringable onto the strands of lacing at each end of the barrette.

7. The accessory of claim 6 wherein two strands of lacing are used to connect the rings on the ends of one side of one barrette with the corresponding rings on the adjacent side of the adjoining barrette.

8. The accessory of claim 5 wherein joining means further includes additional strands of lacing with one end of an additional strand being attachable to a ring on one end of one barrette and with the opposite end thereof being attachable to a ring on the end of another barrette.

9. The accessory of claim 8 wherein the means for providing a decorative appearance further includes additional beads stringable on the additional strands.

* * * * *